US006080298A

United States Patent [19]

Andolfatto

[11] Patent Number: 6,080,298

[45] Date of Patent: Jun. 27, 2000

[54] METHOD FOR ELECTROLYSING A BRINE

[75] Inventor: Francoise Andolfatto, Lyons, France

[73] Assignee: Elf Atochem, S.A., Puteaux, France

[21] Appl. No.: 09/158,889

[22] Filed: Sep. 23, 1998

[30] Foreign Application Priority Data

Sep. 23, 1997 [FR] France ..... 97 11795

[51] Int. Cl.[7] ..... C25B 1/34

[52] U.S. Cl. ..... 205/516; 205/525

[58] Field of Search ..... 205/525, 516

[56] References Cited

U.S. PATENT DOCUMENTS 4,295,944 10/1981 Satoh et al. ..... 205/516

5,693,213 12/1997 Shimamune et al. ..... 205/525

*Primary Examiner*—Arun S. Phasge

*Attorney, Agent, or Firm*—Millen, White, Zelano & Branigan, P.C.

[57] ABSTRACT

Electrolysing an aqueous solution of sodium chloride by means of a cell comprising a cation-exchange membrane which divides the cell into an anode compartment and an cathode compartment in which the said cathode is placed directly against the cation-exchange membrane, the said cathode compartment being supplied with a humidified gas containing oxygen, characterized in that, in order to obtain a concentration by weight of sodium hydroxide between the cation-exchange membrane and the cathode of less than 38.8%, use is made of an aqueous solution of sodium chloride (anolyte) having a concentration by weight of sodium chloride of less than 200 g/l, and in that the water humidifying the gas containing oxygen is in the form of water vapour.

22 Claims, 1 Drawing Sheet

METHOD FOR ELECTROLYSING A BRINE

FIELD OF THE INVENTION

The present invention relates to a method for electrolysing a brine, and more precisely an aqueous solution of sodium chloride, by means of an electrolysis cell having a membrane and a gas electrode, the said electrode being placed directly against the membrane and in a cathode compartment supplied solely with gas.

More particularly, the present invention relates to a method for producing an aqueous solution of sodium hydroxide by electrolysing an aqueous solution of sodium chloride by means of an "oxygen-reduction cathode" having a sodium hydroxide yield (current efficiency) and a membrane lifetime which are improved.

BACKGROUND OF THE INVENTION

Remarkable improvements have been obtained recently in terms of fluorinated ion-exchange membranes, and have made it possible to develop methods for electrolysing sodium chloride solutions by means of ion-exchange membranes. This technique makes it possible to produce hydrogen and sodium hydroxide in the cathode compartment, and chlorine in the anode compartment of a brine electrolysis cell.

In order to reduce energy consumption, it has been proposed in patent application JP 52124496 to use an oxygen-reduction electrode as cathode, and to introduce a gas containing oxygen into the cathode compartment in order to prevent the release of hydrogen, and to reduce the electrolysis voltage significantly.

In theory, it is possible to reduce the electrolysis voltage by 1.23 V by using the cathode reaction with supply of oxygen represented by (1) instead of the cathode reaction without supply of oxygen represented by (2):

$$2H_2O+O_2+4e^- \rightarrow 4OH^- \quad (1)$$

E=+0.40 V (relative to a standard hydrogen electrode).

$$4H_2O+4e^- \rightarrow 2H_2+4OH^- \quad (2)$$

E=−0.83 V (relative to a standard hydrogen electrode).

In general, a conventional membrane electrolysis cell employing the gas electrode technology comprises a gas electrode which is placed in the cathode compartment of the electrolysis cell in order to divide this compartment into a solution compartment, on the ion-exchange membrane side, and a gas compartment on the opposite side. The gas electrode is usually obtained by moulding a mixture of a hydrophobic substance, such as a polytetrafluoroethylene resin (hereafter referred to as PTFE), and a catalyst or support catalyst, so that it has hydrophobic properties preventing liquids from passing through. However, a gas electrode of this type progressively loses its hydrophobic properties when it is exposed to a high temperature of the order of 90° C., and to an aqueous solution of sodium hydroxide having a high concentration of about 32% or more by mass during long-term electrolysis. For this reason, the liquid present in the solution compartment tends to penetrate the gas compartment. Further, because the gas electrode consists of a mixture which principally comprises a material containing carbon and a resin, it is mechanically fragile and tends to crack. These drawbacks have prevented the practical use of a gas electrode of this type for the electrolysis of a brine.

An electrolysis cell configuration of this type is described in patent application FR 2 711 675 (page 2, line 13 to page 3 line 7 and FIG. 1).

In order to resolve the drawbacks mentioned above, it has been proposed in patent JP-B-61-6155 to combine a gas cathode and an ion-exchange membrane into a single integral structure, that is to say a cell of the integral gas electrode/ion-exchange membrane type without division of the cathode compartment.

Although the problems of mechanical fragility have thus been solved, this type of cell configuration nevertheless has drawbacks such as, in particular, changing the membrane and the cathode.

If the water requirement is calculated for a membrane electrolysis cell comprising a cathode consisting of platinized carbon formed with PTFE on a silvered nickel grid, it is found that the electrochemical reaction taking place at the cathode—reaction (1)—consumes 2 mol of water per 4 mol of sodium hydroxide produced, i.e. 0.5 mol of water for one mole of sodium hydroxide.

The sodium hydroxide which is produced must have a strength between 30 and 35%, or else the current efficiency will be reduced by increasing the migration of the hydroxyl ions back through the membrane, and the membrane will be physically degraded. These specifications are given by chlorine/sodium hydroxide membrane manufacturers and are valid for all types of membranes. This involves the addition of water to dilute the sodium hydroxide which is produced, 4.5 mol of water per mole of sodium hydroxide (to obtain 33% strength sodium hydroxide).

The electro-osmotic flux through the membrane supplies 3.5 mol of water per mole of Na+ in the cathode compartment, when the NaCl concentration in the anode compartment is 220 g/l.

0.5+4.5=5 mol of water are therefore consumed for one mole of sodium hydroxide. 3.5 mol of water are therefore added per mol of sodium hydroxide, i.e. a deficit of 1.5 mol of water per mol of sodium hydroxide under conventional operating conditions.

It has been proposed, in patent application EP 686 709, to add this "missing" water in the form of droplets of water in suspension in the oxygen (mist). However, the cathode is a hydrophobic electrode, because of the PTFE used as a binder, which is relatively compact. Further, the oxygen is in contact with the rear face of the electrode. Not all of the water provided by the gas will pass through the cathode to the membrane (in countercurrent with the sodium hydroxide which is produced) and will therefore serve to dilute the sodium hydroxide at the rear of the electrode, and not at the membrane/cathode interface. The result of this is that the amount of water available in contact with the membrane will be at best 3.5 mol of water per mole of sodium hydroxide, assuming that the water needed for the electrochemical reaction is supplied by the gas. This means that the sodium hydroxide concentration at the membrane/cathode interface will be greater than $40/(3.5\times18+40)\times100=38.8\%$. Under these conditions, the current efficiency is poor and the lifetime of the membrane is shortened.

SUMMARY OF THE INVENTION

A method has now been found for electrolysing an aqueous solution of sodium choride by means of an electrolysis cell having a membrane and an oxygen-reduction cathode, comprising a cation-exchange membrane which divides the cell into an anode compartment and a cathode compartment in which the said cathode is placed directly against the cation-exchange membrane, the said cathode compartment being supplied with a humidified gas containing oxygen, characterized in that, in order to obtain a concentration by weight of sodium hydroxide between the cation-exchange membrane and the cathode of less than 38.8%, use is made of an aqueous solution of sodium chloride (anolyte) having a concentration of sodium chloride of less than 200 g/l, preferably between 160 g/l and 190 g/l, and in that the water humidifying the gas containing oxygen is in the form of water vapour.

Furthermore, according to the present invention, the temperature of the cathode compartment may be higher than the temperature of the anode compartment.

According to the present invention, the temperature of the cathode compartment may be higher by 5° C. to 20° C. than the temperature of the anode compartment and, preferably, higher by 10° C. to 15° C.

The cathode compartment is supplied with a gas containing oxygen, humidified beforehand by bubbling through water heated to a temperature ranging from 50° C. to 100° C., and preferably to a temperature of between 80° C. and 100° C.

According to the present invention, the humidified oxygen will be introduced into the cathode compartment in such a way that the water humidifying the oxygen is in the form of water vapour. The situation can be obtained by keeping the temperature of the bubbler less than or equal to that of the cathode compartment.

The proportion by volume of water vapour in the humidified gas containing oxygen is between 10% and 80%, and preferably between 20% and 60%.

The gas containing oxygen may be air, oxygen-enriched air or oxygen. Use will preferably be made of oxygen. The proportion by volume of oxygen in the gas is at least equal to 20%, and preferably at least equal to 50%.

The oxygen-enriched gases are preferably decarbonated beforehand.

According to the present invention, the concentration by weight of sodium hydroxide between the cation-exchange membrane and the cathode is less than 38.8%, preferably less than 37%. The method of the invention has the advantage of leading to a high sodium hydroxide yield (current efficiency), of improving the lifetime of the cation-exchange membranes and of not significantly affecting the voltage of the cell.

Furthermore, the sodium hydroxide obtained by the method according to the present invention has equivalent purity to the sodium hydroxide obtained according to conventional processes with cathodes evolving hydrogen.

The invention may be implemented with a device as described below.

Figure 1:
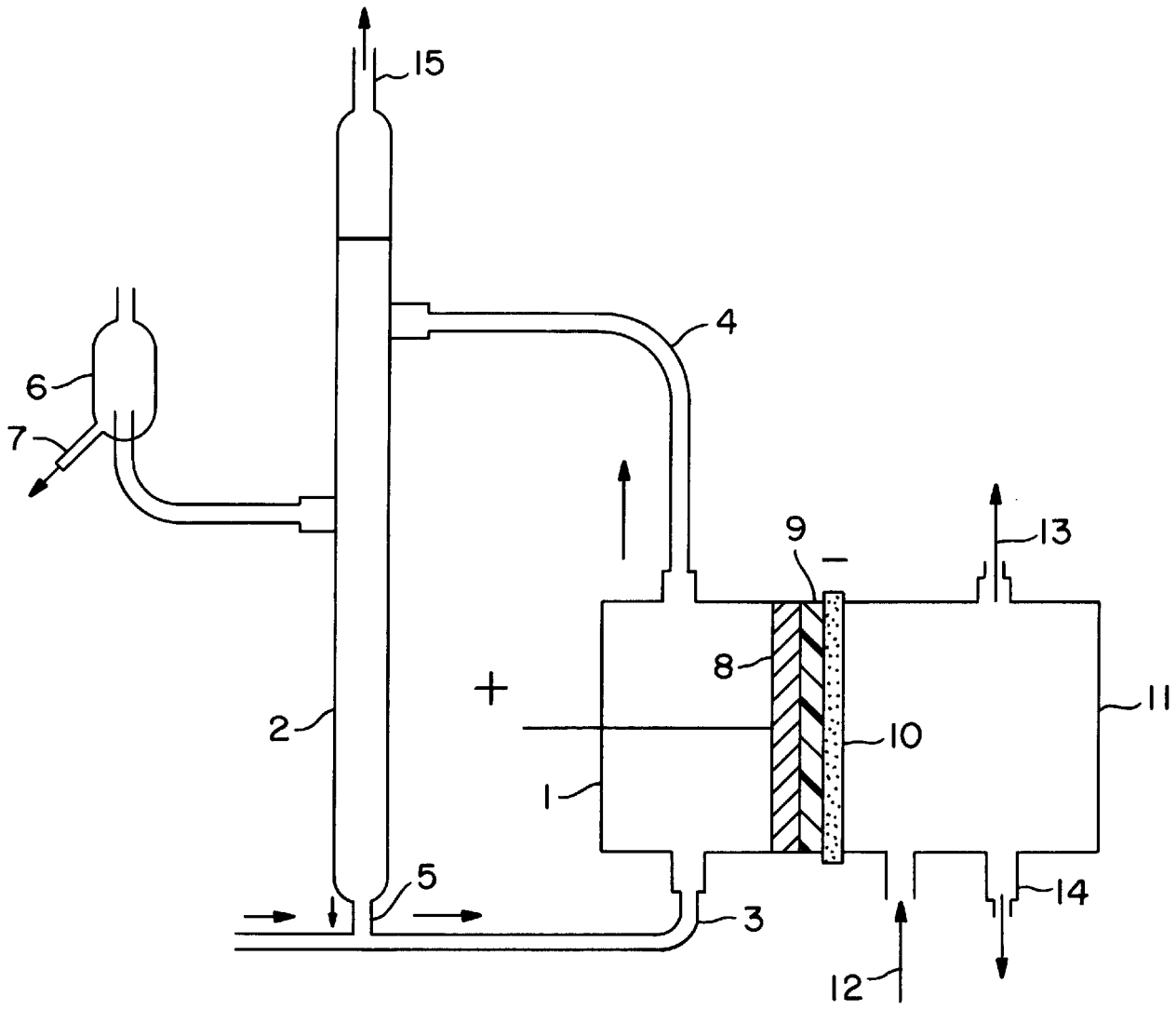
FIG. 1 schematically represents a cell.

DETAILED DESCRIPTION OF DRAWING an anode compartment consisting of a cell body (1) and a degasser (2). The solution of sodium chloride (brine) is introduced through (3) and circulates by lift gas between the body of the cell and the degasser (ducts (4) and (5)). An overflow (6) makes it possible for some of the depleted brine to be removed through (7). Additions of concentrated brine make it possible to keep the NaCl concentration in the anolyte at the selected value;

an anode (8) which may consist of a titanium substrate coated with $RuO_2$, a cation-exchange membrane (9), a cathode (10) which is placed directly against the membrane (9) and may consist of a silvered nickel grid covered with platinized carbon, a cathode compartment (11) consisting of a cell body. The humidified gas containing oxygen is supplied through the bottom of the cell (12) and exits at the top (13) in a water column (not shown in FIG. 1) which fixes the working pressure. The sodium hydroxide is drawn up at (14) directly at the desired strength in the bottom of the cell.

A capillary placed between the cathode seal and the membrane (the capillary is not shown in FIG. 1) makes it possible to sample the sodium hydroxide between the membrane and the cathode in order to measure its concentration. The chlorine exits at (15).

An aqueous solution of NaCl is introduced into the anode compartment (1) through (3) at an NaCl concentration by weight as defined above, and humidified gas containing oxygen is introduced into the cathode compartment (11) through (12); the water humidifying the gas containing oxygen being in the form of water vapour.

There is neither addition of liquid water nor circulation of sodium hydroxide in the device described above.

According to the present invention, the electrolysis temperature is regulated in the region of 80–90° C., it being possible for the temperature of the cathode compartment to be higher than the temperature of the anode compartment.

When a current density is applied to the electrodes, chlorine resulting from the electrolysis of the aqueous solution of NaCl is released in the anode compartment and is discharged via (4) and (15), and the hydroxyl ions formed by reduction of the oxygen form sodium hydroxide with the alkali cations circulating through the membrane.

According to the present invention, operation is advantageously carried out with an oxygen flow rate which is greater than the cathode consumption. The temperature of the water in which the gas containing oxygen is bubbled may be increased or decreased, as can be the flow rate of humidified gas containing oxygen, in order to adjust the strength of the sodium hydroxide at the outlet (14) of the cell.

The following examples illustrate the invention.

Use is made of the cell for electrolysing aqueous sodium chloride solution as represented in FIG. 1.

The electrolysis is carried out with a power source which is connected to the anode (+) and to the cathode (−) of the cell so as to apply a current density i of 3 to 4 $kA/m^2$ to the cell.

The anode (8) consists of a titanium substrate coated with ruthenium oxide $RuO_2$.

The cathode (10) consists of platinized carbon formed with PTFE on a silvered nickel grid (10% of platinum on the carbon; 0.56 mg of Pt per $cm^2$).

This cathode is marketed by the company E-TEK Inc.

The cation-exchange membrane (9) is a Nafion N966 membrane produced by the company du Pont de Nemours.

The gas which is used is pure oxygen.

EXAMPLE 1 (not according to the invention)

USE UNDER CONVENTIONAL CONDITIONS OF A CHLORINE/SODIUM HYDROXIDE ELECTROLYSIS CELL

Operating conditions:

Nafion® N966 Membrane; $RuO_2$-covered titanium substrate anode.

Anode temperature=cathode temperature=80° C.

Current density i=3 $kA/m^2$.

The oxygen is humidified by bubbling through water at 80° C. before it enters the cell. Its flow rate is 5 l/h.

The proportion by volume of water vapour in the humidified oxygen is about 55%.

NaCl concentration by weight in the anolyte=220 g/l.

Sodium hydroxide concentration by weight at the outlet of the cell=30%.

Sodium hydroxide concentration by weight between the membrane and the cathode=40%.

Cell voltage=2.2 V.

Sodium hydroxide yield=93% (result) calculated over 24 hours of continuous operation).

It is found that the sodium hydroxide strength at the outlet of the cell is correct, but the yield is much less than the values expected with this type of membrane.

EXAMPLE 2 (not according to the invention)

ADDITION OF WATER BY INCREASING THE OXYGEN FLOW RATE

Operating conditions:

Nafion® N966 Membrane; $RuO_2$-covered titanium substrate anode.

Anode temperature=cathode temperature=80° C.

Current density i=3 kA/m$^2$.

The oxygen is humidified by bubbling through water at 80° C. before it enters the cell; its flow rate is doubled in comparison with Example 1.

NaCl concentration by weight in the anolyte=220 g/l.

Sodium hydroxide concentration by weight at the outlet of the cell=28.5%.

Sodium hydroxide concentration by weight between the membrane and the cathode=39%.

Cell voltage Ecell=2.2 V.

Sodium hydroxide yield=93.4% (result calculated over 24 hours of continuous operation).

It is found that the sodium hydroxide strength at the output of the cell is too low, the sodium hydroxide concentration at the membrane/cathode interface is unchanged and is high, and the yield is substantially identical: the water added by the oxygen does not pass through the cathode to dilute the sodium hydroxide at the membrane/cathode interface, and it therefore serves only to dilute the sodium hydroxide at the rear of the cathode.

EXAMPLE 3 (according to the invention)

REDUCTION IN THE NACL CONCENTRATION IN THE ANOLYTE

Operating conditions:

Nafion® N966 Membrane; $RuO_2$-covered titanium substrate anode.

Anode temperature=cathode temperature=80° C.

Current density i=3 kA/m$^2$.

The oxygen is humidified by bubbling through water at 80° C. before it enters the cell; the oxygen flow rate is identical to that in Example 1.

NaCl concentration by weight in the anolyte=190 g/l.

Sodium hydroxide concentration by weight at the outlet of the cell=30%.

Sodium hydroxide concentration by weight between the membrane and the cathode=37.5%.

Cell voltage=2.2 V.

Sodium hydroxide yield=95.9% (result calculated over 24 hours of continuous operation).

It is found that the sodium hydroxide strength at the outlet of the cell is unchanged, the yield is much higher than that obtained in Example 1, and the cell voltage is not affected.

EXAMPLE 4 (according to the invention)

The operating conditions are identical to those in Example 3, except for the fact that the NaCl concentration by weight in the anolyte is 170 g/l.

The results are as follows:

sodium hydroxide concentration by weight at the cell outlet: 32%, sodium hydroxide concentration by weight between the membrane and the cathode: 35%, sodium hydroxide yield: 96%.

The preceding examples can be repeated with similar success by substituting the generically or specifically described reactants and/or operating conditions of this invention for those used in the preceding examples.

The entire disclosure of all applications, patents and publications, cited above, and of corresponding French application No. 97/11795, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a method comprising conducting electrolysis of an aqueous solution of sodium chloride with an electrolysis cell comprising an anode an oxygen-reduction cathode, and a cation-exchange membrane which divides the cell into an anode compartment containing an anolyte of an aqueous solution of sodium chloride and a cathode compartment in which said cathode is placed directly against the cation-exchange membrane, said cathode compartment being supplied with a humidified gas containing oxygen, the improvement wherein said anolyte containing an aqueous solution of sodium chloride is provided with a concentration by weight of sodium chloride of less than 200 g/l, and the water humidifying the gas containing oxygen is provided sole in the form of water vapour, and maintaining reaction conditions so as to obtain a concentration by weight of sodium hydroxide between the cation-exchange membrane and the cathode of less than 38.8%.

2. A method according to claim 1, wherein the concentration by weight of sodium chloride in the aqueous solution of sodium chloride is between 160 g/l and 190 g/l.

3. A method according to claim 1, wherein the gas is oxygen.

4. A method according to claim 3, wherein the concentration by weight of sodium chloride in the aqueous solution of sodium chloride is between 160 g/l and 190 g/l.

5. A method according to claim 1, wherein the proportion by volume of water vapour in the humidified gas containing oxygen is between 10% and 80%.

6. A method according to claim 5, wherein the concentration by weight of sodium chloride in the aqueous solution of sodium chloride is between 160 g/l and 190 g/l.

7. A method according to claim 5, wherein the proportion by volume of water vapour in the humidified gas containing oxygen is between 20% and 60%.

8. A method according to claim 7, wherein the concentration by weight of sodium chloride in the aqueous solution of sodium chloride is between 160 g/l and 190 g/l.

9. A method according to claim 8, wherein the temperature of the cathode compartment is higher than the temperature of the anode compartment.

10. A method according to claim 8, wherein th e temperature of the cathode compartment is higher by 5° C. to 20° C. than the temperature of the anode compartment.

11. A method according to claim 8, wherein the temperature of the cathode compartment is higher by 10° C. to 15° than the temperature of the anode compartment.

12. A method according to claim 7, wherein the temperature of the cathode compartment is higher than the temperature of the anode compartment.

13. A method according to claim 7, where in the temperature of the cathode compartment is higher by 5° C. to 20° C. than the temperature of the anode compartment.

14. A method according to claim 7, wherein the temperature of the cathode compartment is higher by 10° C. to 15° than the temperature of the anode compartment.

15. A method according to claim 1, wherein the temperature of the cathode compartment is higher than the temperature of the anode compartment.

16. A method according to claim 15, wherein the temperature of the cathode compartment is higher by 5° C. to 20° C. than the temperature of the anode compartment.

17. A method according to claim 16, wherein the temperature of the cathode compartment is higher by 10° C. to 15° C. than the temperature of the anode compartment.

18. A method according to claim 17, wherein the concentration by weight of sodium chloride in the aqueous solution of sodium chloride is between 160 g/l and 190 g/l.

19. A method according to claim 16, wherein the concentration by weight of sodium chloride in the aqueous solution of sodium chloride is between 160 g/l and 190 g/l.

20. A method according to claim 15, wherein the concentration by weight of sodium chloride in the aqueous solution of sodium chloride is between 160 g/l and 190 g/l.

21. A process according to claim 1, wherein said water vapor is in a concentration less than that of a saturated state.

22. A process according to claim 1, wherein the concentration of the sodium hydroxide between the membrane and the cathode is periodically measured.

* * * * *